US010322904B2

(12) United States Patent
Arredondo et al.

(10) Patent No.: US 10,322,904 B2
(45) Date of Patent: Jun. 18, 2019

(54) MEDIA DETECTION

(71) Applicants: Hewlett-Packard Development Company, L.P., Houston, TX (US); Alberto Arredondo, Sant Cugat del Valles (ES); Ricardo Sanchis Estruch, Sant Cugat del Valles (ES); Eduardo Martin Orue, Sabadell (ES); Pau Martin Vidal, Sant Cugat del Valles (ES); Dani Gonzalez Perello, Terrassa (ES)

(72) Inventors: Alberto Arredondo, Sant Cugat del Valles (ES); Ricardo Sanchis Estruch, Sant Cugat del Valles (ES); Eduardo Martin Orue, Sabadell (ES); Pau Martin Vidal, Sant Cugat del Valles (ES); Dani Gonzalez Perello, Terrassa (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/760,286

(22) PCT Filed: Sep. 28, 2015

(86) PCT No.: PCT/EP2015/072238
§ 371 (c)(1),
(2) Date: Mar. 15, 2018

(87) PCT Pub. No.: WO2017/054835
PCT Pub. Date: Apr. 6, 2017

(65) Prior Publication Data

US 2018/0257898 A1 Sep. 13, 2018

(51) Int. Cl.
*B65H 43/04* (2006.01)
*B41J 11/00* (2006.01)
(Continued)

(52) U.S. Cl.
CPC ..... *B65H 43/04* (2013.01); *B41J 11/0085* (2013.01); *B41J 11/0095* (2013.01);
(Continued)

(58) Field of Classification Search
CPC ..... B65H 2406/351; B65H 2553/10; B65H 2553/11; B65H 43/04; B65H 2511/528; B41J 11/0085
See application file for complete search history.

(56) References Cited

U.S. PATENT DOCUMENTS 5,126,790 A 6/1992 Moore et al.
5,207,413 A * 5/1993 Maron ..... B65H 5/222 271/103
(Continued)

FOREIGN PATENT DOCUMENTS

JP 2002145478 5/2002
JP 2011020424 2/2011

OTHER PUBLICATIONS

Machine translation of JP 2011020424, retrieved Sep. 5, 2018 (Year: 2011).*
(Continued)

*Primary Examiner* — Michael C McCullough
(74) *Attorney, Agent, or Firm* — HP Inc. Patent Department

(57) ABSTRACT

An example printing apparatus in accordance with the present disclosure may comprise a platen (10) on which print media may advance and which may comprise a hole (20) that is open towards a print media advance surface and in fluid communication with a vacuum source (40) and with a pressure sensor (50). In implementations of the apparatus a control unit (60) may detect the presence of print media at the hole (20) if the pressure sensor (50) measures an air pressure below a predetermined threshold.

14 Claims, 4 Drawing Sheets

(51) Int. Cl.
*B65H 29/24* (2006.01)
*B65H 29/52* (2006.01)

(52) U.S. Cl.
CPC ..... *B65H 29/241* (2013.01); *B65H 29/52* (2013.01); *B65H 2406/351* (2013.01); *B65H 2511/528* (2013.01); *B65H 2515/342* (2013.01); *B65H 2701/1311* (2013.01); *B65H 2701/1313* (2013.01)

(56) References Cited

U.S. PATENT DOCUMENTS

| | | | | |
|---|---|---|---|---|
| 5,461,467 | A * | 10/1995 | Malachowski ..... | B65H 29/242 271/197 |
| 6,154,240 | A | 11/2000 | Hickman | |
| 6,851,672 | B1 | 2/2005 | Shmaiser et al. | |
| 8,544,842 | B2 | 10/2013 | Schulze-Hagenest et al. | |
| 2003/0038420 | A1 | 2/2003 | Cleary et al. | |
| 2014/0054852 | A1 * | 2/2014 | Hongo ..... | B65H 7/02 271/264 |

OTHER PUBLICATIONS

Paper Transport Simulation Technology, Fuji Xerox, Jan. 29, 2015, Available online at: <http://www.fujixerox.com/eng/company/technology/base/fundamental/paperpath.html >.

International search report (ISR) in corresponding PCT patent application PCT/EP2015/072238, dated Jun. 17, 2016.

* cited by examiner

FIG. 1
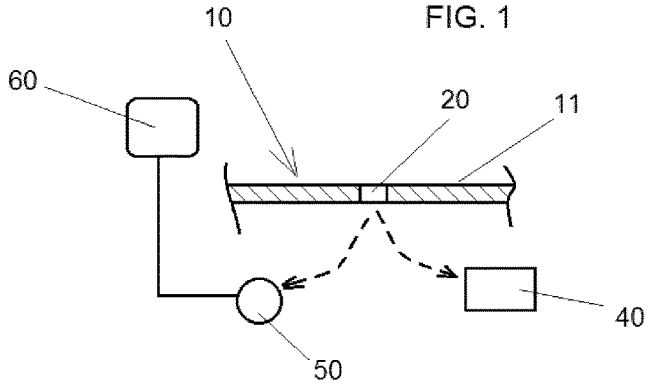
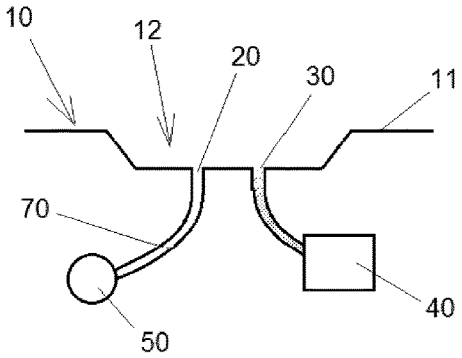
FIG. 2a
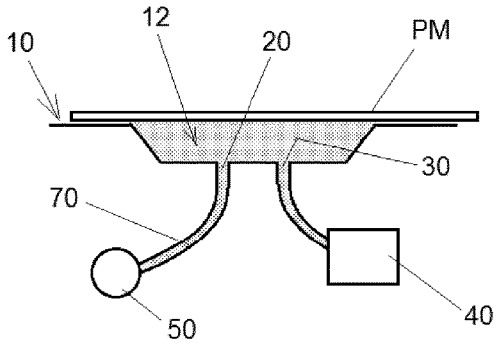
FIG. 2b
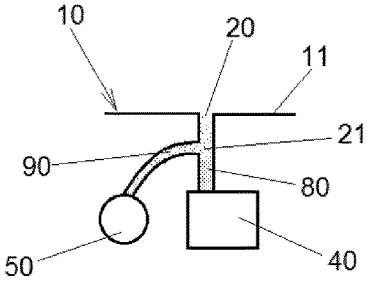
FIG. 3a
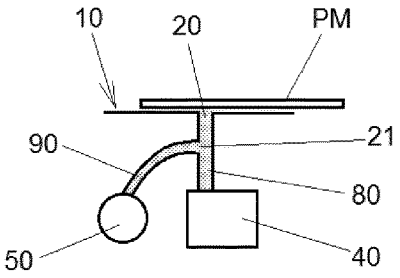
FIG. 3b

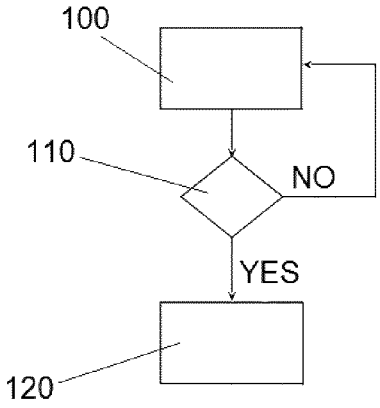
FIG. 5
FIG. 6
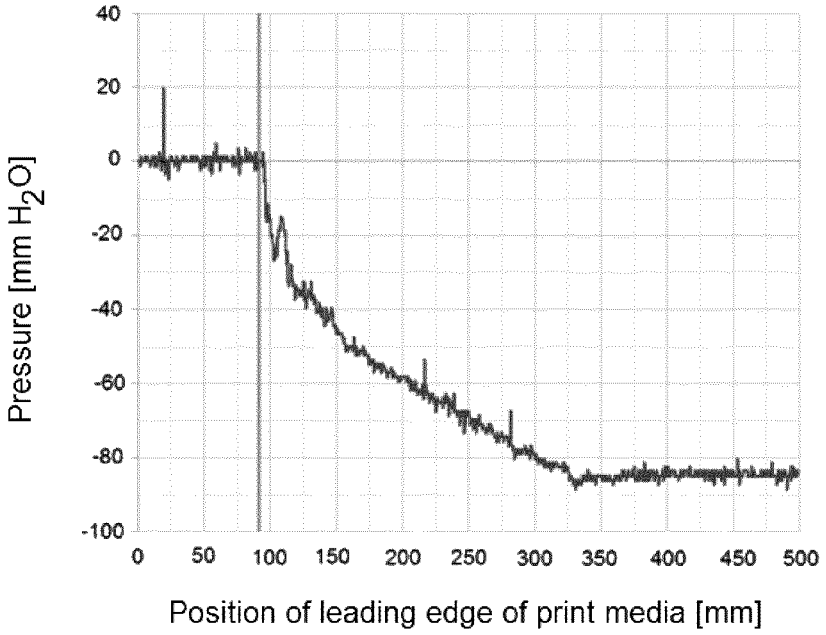

MEDIA DETECTION

BACKGROUND

In printing apparatus such as for example some large format printers, a print medium may advance on a flat platen past a print zone, where printing fluid is deposited on print media, for example by inkjet printheads. In some apparatus print media may be maintained flat on the platen during advance by a hold-down system, such as a vacuum hold-down system.

Under some circumstances, the print medium during advance may touch or crash with a part of the printing apparatus such as the printheads, causing a jam which may damage the printheads themselves or other parts of the printer.

BRIEF DESCRIPTION

Some non-limiting examples of the present disclosure will be described in the following with reference to the appended drawings, in which:

FIG. 1 is a schematic drawing showing examples of printing apparatus as disclosed herein;

FIGS. 2*a*, 2*b* and 3*a*, 3*b* are schematic drawings of examples of printing apparatus with print media detection systems according to implementations as disclosed herein;

FIG. 5 is a flowchart illustrating example methods for detecting print media according to implementations disclosed herein;

FIG. 6 is a diagram illustrating the pressures measured by a pressure sensor in apparatus according to some examples disclosed herein.

DETAILED DESCRIPTION

Figure 4:
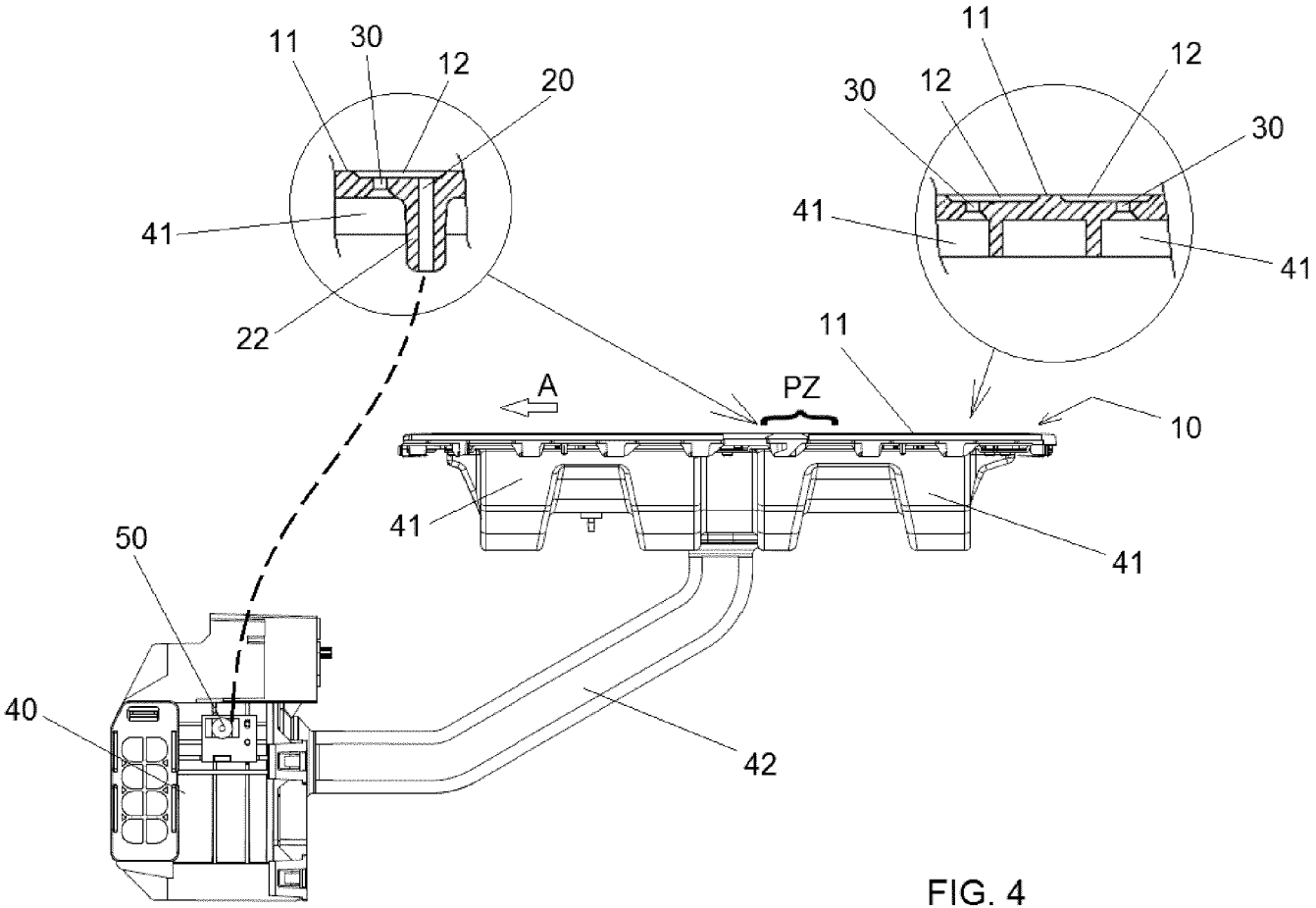
FIG. 4 is a schematic view in elevation showing part of a printing apparatus according to examples disclosed herein.

Some implementations of printing apparatus such as large format printers may comprise a horizontal, substantially flat platen for supporting print media. Print media, for example web print media or sheets of different length, may be advanced on the platen by a driving mechanism, past a print zone where printing fluid is deposited on the print media. The printing fluid may for example be ejected by inkjet printheads that are above the platen.

Printheads may for example be mounted on a carriage that prints a swath while travelling along a scan axis that is perpendicular to the print media advance direction, and the print media may be advanced a predetermined length between swaths. In page-wide array printers, a plurality of stationary printheads, or a wide printhead, spanning all the width of the printer, deposit printing fluid on a print medium that advances continuously on the platen.

In some circumstances, when a print medium advances in the apparatus during a printing operation it may happen that it crashes against one of the parts of the apparatus: for example, the leading edge of the print medium may crash against the printheads, for example because it is curled.

This situation may cause a print media jam in the apparatus, with the risk of potential damage to the printheads or to the print media advance mechanism.

It may therefore be useful to detect a print media jam as soon as possible, to reduce the associated risks. In some printing apparatus it is known to detect such a situation by algorithms based on several inputs and conditions, including information provided by a sensor to detect the presence of print media at specific positions in the apparatus. Detecting the presence of print media may also be useful in other circumstances during printing operation.

It is known to detect the presence of print media, for example with optical sensors, at the print media input of the printing apparatus.

However, optical sensors may not be easily placed near the print zone in printing apparatus that employ a vacuum hold-down system to maintain the print media flat on the platen, because their installation may cause vacuum leaks and affect the vacuum system.

On the other hand, sensors that contact the print media for detecting the presence may not be a satisfactory solution in the print zone or after the print zone in an inkjet printing apparatus, because contact may damage the printed image.

The present disclosure provides implementations of methods and systems for detecting print media on the platen of a printing apparatus.

In implementations of a printing apparatus as shown in FIG. 1, the apparatus may comprise a platen 10 having a print media advance surface 11, on which print media may be supported and may advance. The printing apparatus may also comprise a vacuum source 40 and a pressure sensor 50.

The platen 10 may be substantially horizontal, i.e. horizontal or with a small incline, and/or it may be substantially planar or flat, even though it may comprise channels or recessed portions.

The platen 10 may comprise a hole 20, that may be open towards the print media advance surface 11 of the platen 10. The hole 20 may also be connected with the vacuum source 40 and with the pressure sensor 50 of the apparatus, such as to be in fluid communication with them, as shown schematically in FIG. 1 and as will be described in more detail later on.

Examples of printing apparatus according to implementations disclosed herein may comprise a control unit 60, as shown in FIG. 1. The control unit 60 may receive an output of the pressure sensor 50 and it may determine that a print medium is present on the platen at the hole 20 if the pressure sensor 50 measures an air pressure below a predetermined threshold.

The hole in fluid communication with the pressure sensor may be located at a suitable position on the platen, where it may be convenient to detect the presence of print media. For example it is possible to place it in the proximity of the print zone in an apparatus with a vacuum print media hold-down system, and indeed it may be provided in combination with such a hold-down system.

Furthermore, in implementations of such a printing apparatus some of the elements of the print media detection system may be part of the vacuum hold-down system, for example the pressure sensor, and therefore an apparatus may be provided with a print media detection system at a relatively low cost.

Implementations of the detection system may be robust and reliable, as they may be unaffected by aerosol, printing fluid, print media particles or the like, and may allow fast detection of print media at predetermined positions on the platen. For example this may be useful, amongst others, in page-wide printing apparatus, where the speed of print media advance is high and therefore it is useful to detect malfunctions as early as possible.

According to some implementations or examples of a printing apparatus, the hole 20 in the platen 10 is after or downstream the print zone, in the direction of print media advance, such that it allows detecting that the print medium has advanced along the print zone.

In some implementations, the control unit 60 may determine that a potential print media jam situation has arisen if the presence of a print medium is not detected at the hole 20 within a predetermined time period after a triggering event has occurred: for example, after the print medium PM is detected at the print media input of the printing apparatus.

In some implementations, the control unit 60 may determine that a print media jam situation has arisen if the presence of a print medium is not detected at the hole 20 after the print medium PM has advanced a predetermined length from the moment the triggering event has occurred.

In other words, the control unit 60 may determine that a potential print media jam situation has arisen if the print medium has entered the printing apparatus and advanced, but has not reached the position of the hole when it should have. If the hole for example is after the print zone, then a potential print media jam situation in the print zone may be detected.

FIGS. 2*a* and 2*b* show implementations of a printing apparatus as disclosed above, comprising a print media detection system, in two different conditions. FIGS. 2*a* and 2*b* show partial views of the platen 10 of a printing apparatus, on which a print medium PM (FIG. 1*b*) may be supported and may advance.

In some examples such as illustrated in FIGS. 2*a* and 2*b* the platen 10 may have a recessed portion 12, and the hole 20 may be provided in this portion of the platen. The hole 20 is open towards the print media advance surface 11 and may be in fluid communication with the pressure sensor 50 through a conduit 70.

In the recessed portion 12 of the platen 10 there may be a vacuum opening 30, in fluid communication with the vacuum source 40. The hole 20 may therefore also be in fluid communication with the vacuum source 40, through the recessed portion 12 and the vacuum opening 30.

In some implementations the recessed portion 12, the vacuum opening 30 and the vacuum source 40 may be part of a vacuum hold-down system.

In the situation of FIG. 2*a*, wherein no print media is present over the recess 12 in the platen, the air pressure in correspondence with the hole 20, which may be measured by the pressure sensor 50, is atmospheric pressure or close to atmospheric pressure.

When a print medium PM advances on the platen 10 and covers the recessed portion 12, as shown in FIG. 2*b*, it is drawn downwards by the negative pressure caused by the vacuum source 40, substantially closing the recessed portion 12, and a level of vacuum is established in the vacuum opening 30, the recessed portion 12, and the hole 20. In this situation, the air pressure in correspondence with the hole 20, which may be measured by the pressure sensor 50, is lower than atmospheric pressure. It may be equal or close to the level of vacuum provided by the vacuum source 40 if there are no other losses in the vacuum system.

FIGS. 3*a* and 3*b* show implementations of a printing apparatus, comprising a print media detection system, in two different conditions. In some examples such as illustrated in FIGS. 3*a* and 3*b* the hole 20 may be provided in a substantially flat portion of the platen 10. The hole 20 is open towards the print media advance surface 11.

In examples according to FIGS. 3*a* and 3*b*, a conduit 80 may be provided for fluid communication of the hole 20 with the vacuum source 40, and the conduit 80 may comprise a tee branch 90, connected to the pressure sensor 50. The hole 20 may therefore be in fluid communication with the vacuum source 40 and with the pressure sensor 50.

In the situation of FIG. 3*a*, wherein no print media is present over the hole 20 in the platen 10, the air pressure in a position 21 which is associated with the hole 20, depends on the geometry of conduit 80 and tee branch 90 and on the negative pressure exerted by the vacuum source 40. It is a pressure below atmospheric pressure, but above the pressure of the vacuum source 40. The pressure in position 21 associated with the hole 20 may be measured by the pressure sensor 50.

When a print medium PM advances on the platen 10 and covers the hole 20, as shown in FIG. 3*b*, it is drawn downwards by the negative pressure caused by the vacuum source 40 in the hole 20, substantially closing the hole 20 to the environment, and a level of vacuum is established in the hole 20, the conduit 80 and the tee branch 90. In this situation, the air pressure in the position 21 associated with the hole 20, which may be measured by the pressure sensor 50, is below the pressure measured in the situation of FIG. 3*b*. It may be equal or close to the level of vacuum provided by the vacuum source 40 if there are no other losses in the vacuum system.

In some implementations of a printing apparatus, comprising a conduit 80 for providing fluid communication of the hole 20 with the vacuum source 40 and with a tee branch 90 connected to the pressure sensor 50, the hole 20 and associated conduits may also be provided in a recessed portion of the platen 10. For example, in some implementations comprising a platen 10 with a recessed portion 12 such as shown in FIGS. 2*a* and 2*b*, a single hole 20 may be provided instead of a hole 20 and a vacuum opening 30, and the single hole 20 may be connected via a conduit and tee branch both to the vacuum source 40 and to the pressure sensor 50.

In implementations of a printing apparatus the platen may comprises a recessed portion, the hole may be in a recessed portion, and the apparatus may comprise a vacuum chamber between the platen and the vacuum source, in correspondence with the recessed portion and in fluid communication with the hole.

For example, FIG. 4 shows in a schematic elevation view implementations of a printing apparatus with such a vacuum chamber. The apparatus may comprise a platen 10 with recessed portions 12 and a vacuum chamber 41, under the platen 10, such as to be in correspondence with the recessed portions 12, and connected to a vacuum source 40, such as a vacuum fan, by a vacuum pipe 42. A pressure sensor 50 may be provided.

The recessed portions 12 may comprise vacuum openings 30, for example as shown in the enlarged detail on the right of FIG. 4, that may illustrate a detail of the platen 10, and the assembly may provide a hold-down system for print media on the platen 10.

In implementations such as shown in FIG. 4, a hole 20 may be provided in one of the recessed portions 12, as shown in the enlarged detail on the left of FIG. 4, and may be in fluid communication with the pressure sensor 50, as shown by the dotted line in FIG. 4. The pressure sensor 50 may therefore measure the air pressure in a position associated with the hole 20.

In some examples the fluid communication between the hole 20 and the pressure sensor 50 may be for example through a tube 22 that may isolate the hole 20 from the vacuum chamber 41 on the underside of the platen 10, as shown in the enlarged detail on the left of FIG. 4, although the hole 20 may still be in fluid communication with the vacuum chamber 41 via the recessed portion 12 of the platen and the vacuum opening 30.

In some implementations the hole 20 may be provided for example in a recessed portion 12 that is near a print zone PZ where printing fluid is deposited on the print media. For example, the hole 20 may be provided after the print zone PZ in the direction of print media advance, which is shown by arrow A.

The pressure sensor 50 may also be employed for calibrating the vacuum system during installation of the printing apparatus.

Also disclosed herein are implementations of a print media detection system for a printing apparatus, such as shown in FIG. 1.

According to some implementations, a print media detection system may comprise a platen 10 with a print media advance surface 11, and a hole 20 in the platen that is open towards the print media advance surface 11. The hole 20 may be put in fluid communication with a vacuum source 40 of a printing apparatus. The system may comprise a conduit, such as for example conduit 70 in FIG. 2*a*, or for example conduit 90 in FIG. 3*a*, for putting the hole 20 in fluid communication with a pressure sensor 50 of the printing apparatus.

In some implementations, the hole 20 may be foreseen in the central zone of the platen 10 in the print media width direction, i.e. in a direction perpendicular to the print media advance direction, so that print media of any width may pass over the hole during printing.

FIG. 5 illustrates example methods for detecting the presence of print media in a printing apparatus which comprises a platen on which print media may advance, according to implementations disclosed herein.

As shown in FIG. 5, implementations of a method for detecting the presence of print media on a platen of a printing apparatus may comprise:

- in block 100, measuring the air pressure in a position associated with a hole in the platen, the hole being in fluid communication with a vacuum source and being open towards the print media advance surface of the platen;
- in block 110, verifying if the measured air pressure is below a predetermined threshold; and
- in case the measured air pressure is below the threshold, determining in block 120 that a print medium is present at the hole in the platen.

In case the measured air pressure is not below the threshold in the verification in block 110, the method returns to block 100.

In implementations of a printing apparatus such as illustrated in FIGS. 1 to 4, the measured air pressure when a print medium is present on the platen 10 at the hole 20 may be equal to or close to the vacuum pressure provided by the vacuum source 40, if there are no other losses in the vacuum system. When no print medium is present at the hole 20 on the platen, the air pressure measured by the pressure sensor 50 is higher: it may be equal or close to atmospheric pressure in the cases such as those illustrated in FIG. 2*a* or FIG. 4, for example, and it may be an intermediate value between the atmospheric pressure and the vacuum pressure in cases such as those illustrated in FIG. 3*a*.

A predetermined threshold that may be employed in implementations of methods disclosed herein may be for example a percentage of the vacuum pressure that is provided by the vacuum source 40 and measured by the pressure sensor 50 when a print medium is present: it may be for example a value of about 20% of the vacuum pressure.

In some implementations of the method, the predetermined threshold may be for example a value based on the atmospheric pressure, for example a value of about 80% of the atmospheric pressure.

Selecting values of the predetermined threshold closer to the atmospheric pressure allows faster detection of the print media, and therefore also faster detection of a situation in which a print medium should have reached the hole 20 but has not.

FIG. 6 is a diagram that illustrates the variation of the pressure measured by the pressure sensor 50 in implementations of the method, for example a method applied to a printing apparatus as shown in FIG. 4, comprising a vacuum hold-down system with a plurality of recessed portions 12 and vacuum openings 30 connected to a vacuum chamber 41.

In this example the recessed portion 12 with the hole 20 is placed at about 90 mm from the beginning of the print platen 10 where the print media enter. The vacuum source provides a vacuum pressure of about −85 mm $H_2O$, and the speed of advance of print media is 15 inches per second (37.5 cm/s).

In FIG. 6, the relative pressure measured by the pressure sensor 50 (relative pressure) is plotted against the position of the leading edge of a print medium that is advancing on the platen. The vertical line in the diagram indicates the position on the platen of the recessed portion 12 with the hole 20; the beginning of the platen is indicated by position 0.

From left to right, the diagram illustrates that when the print medium starts advancing on the platen, and its leading edge has not reached the position of the hole 20, the pressure measured by the sensor 50 generally oscillates around a value of 0 mm $H_2O$, i.e. atmospheric pressure.

When the leading edge reaches the position of the recessed portion 12 of the platen where the hole 20 is located, and advances covering this recessed portion 12, the air pressure in hole 20 may descend abruptly as shown to the right of the vertical line, because the hole 20 is then subject to the negative pressure originating from the vacuum source 40, through the vacuum opening 30. The level or value of the negative pressure is not yet the maximum negative pressure provided by the vacuum source 40, because part of the platen 10 is not yet covered by the print medium and therefore there are air losses through the vacuum openings 30 of the platen downstream or after the position of the hole 20.

As the leading edge of the print medium advances further downstream of the hole 20, and covers a larger proportion of the vacuum openings 30 of the platen, the pressure of the whole vacuum system decreases, and therefor the pressure measured by the pressure sensor 50 also decreases, until it reaches the negative pressure provided by the vacuum source once all the platen is covered by the print medium.

As shown in the diagram, in this example the pressure measured by the sensor is down to about −15 mm $H_2O$ after a print medium advance of about 8 mm from the moment the leading edge of the print medium reaches the hole 20. This shows that in implementations of the apparatus and methods disclosed herein it is possible to detect a situation of absence of a print medium (that was expected to reach the hole 20), which may indicate that a print media jam has occurred, when just a short length of print medium may be involved in the print media jam.

Implementations of methods disclosed herein for detecting the presence of print medium on the platen of a printing apparatus may be applied in printing apparatus such as disclosed above with reference to FIGS. 2*a*/2*b* and/or FIG. 4. Implementations of methods disclosed herein may also be applied in printing apparatus such as disclosed above with reference to FIGS. 3*a*/3*b*.

Figure 7:
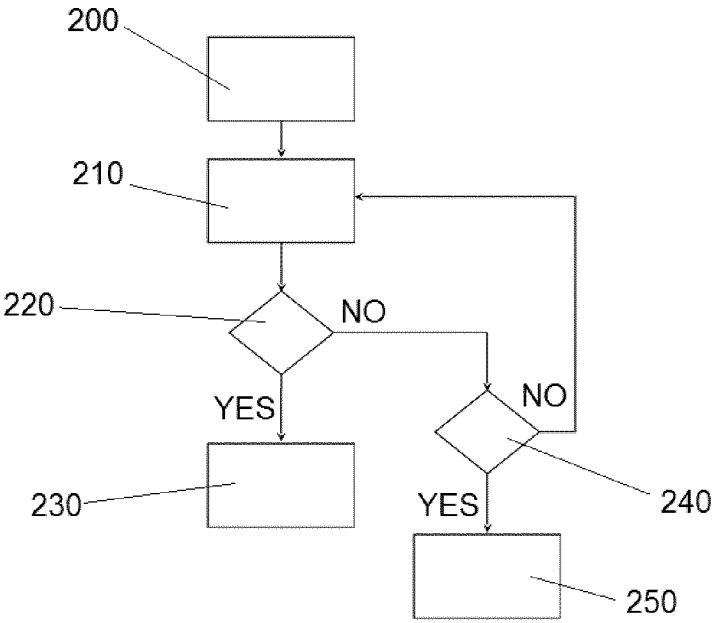

FIG. 7 is a flowchart illustrating implementations of a method for detecting print media and for determining if a print media jam situation may have occurred. In an example, the hole 20 may be after a print zone of the printing apparatus, in a direction of print media advance.

In such cases, and as shown in FIG. 7, implementations of the method may comprise, in block 200, detecting that a triggering event has occurred. The triggering event may be, for example, the entry of the leading edge of a print medium on the platen, the presence of the print medium in a position upstream or before the position of the hole 20, the activation of the print medium advance system, etc., When the triggering event has been detected, the method may comprise measuring the air pressure at the hole 20, in block 210.

In block 220 the measured pressure is compared with a predetermined threshold: if the measured pressure is below this threshold, it is determined in block 230 that a print medium is present at the hole in the platen.

If in block 220 it is found that the measured pressure is not below the predetermined threshold, which would indicate that no print medium is present at the hole 20, then the method may comprise, in block 240, verifying if a predetermined time period has lapsed, or if a predetermined length of print medium has advanced, after the triggering event, for example after the leading edge of the print medium has been detected at the beginning of the platen.

The predetermined time period or print media advance length are selected depending on the triggering event used, on the speed of advance of the print medium, on the desired level of security, etc.

In case of a positive determination in block 240, then it may be determined in block 250 that a print media jam has occurred. For example, the print medium may have crashed with the printheads in the print zone. Suitable actions may then be taken, such as issuing an alarm signal, stopping the advance of the print medium, or the like.

In case of a negative determination in block 240, then the method may return to block 210.

Figure 8:
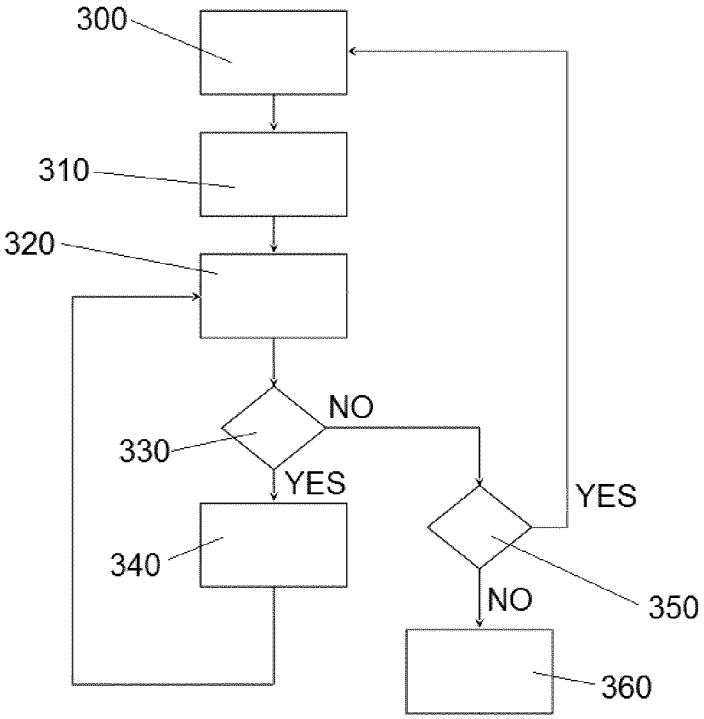
FIGS. 7 and 8 are flowcharts illustrating example methods for detecting print media and determining print media jam situations according to implementations disclosed herein.

FIG. 8 is a flowchart illustrating implementations of a method for detecting print media on the platen and for determining if a print media jam situation may have occurred downstream or after the position of the hole 20 in the direction of print media advance, for example at the outlet of the platen.

If a print medium crashes at the outlet of the platen, and since the print medium continues entering and advancing on the platen, the print medium tends to rise from the platen forming a bubble and therefore uncovering at least some of the vacuum openings 30 of the platen. As a consequence, the vacuum level in the vacuum system, and therefore the air pressure measured by the pressure sensor 50 connected to the hole 20 in the platen 10, may increase.

Implementations of a method disclosed herein that allows detecting a print media jam downstream or after the position of the hole 20 may comprise detecting the presence of print media at the hole 20, and then continuing measuring the air pressure at the hole 20 and determining that a print media jam has occurred if, within a predetermined time period or a predetermined print media advance length after a triggering event, the measured pressure raises above a predetermined threshold.

Implementations of such a method allow detecting print media jams at the exit of the printing apparatus shortly after they occur, even in the case of relatively long sheets of print media, for which the detection of the trailing edge of the print medium takes a longer time.

As shown in FIG. 8, implementations of such a method may comprise, in block 300, detecting the presence of a print medium at the hole, for example as described in relation to FIG. 5, and then, in block 310, detecting that a triggering event has occurred.

The triggering event may be, for example, the presence of the print medium at a predetermined position downstream or after the hole in the direction of print media advance, for example at the outlet of the platen. This may be detected for example by suitable sensors, or by the detection of an air pressure at the hole 20 that is equal or close to the vacuum level provided by the vacuum source 40, which may indicate that the print medium has covered all the platen.

Once the triggering event has been detected, the method may comprise continuing measuring the air pressure at the hole 20, in block 320.

In block 330 the measured pressure is compared with a predetermined threshold: if the measured pressure is below the threshold, it is determined in block 340 that a print medium is still present at the hole 20 in the platen, and the method may return to block 320.

If in block 330 it is found that the measured pressure is not below the predetermined threshold, which would indicate that the air pressure has risen and no print medium is present at the hole 20, then the method may comprise, in block 350, verifying if a predetermined time period has lapsed, or if a predetermined length of print media has advanced, after the triggering event.

In case of a negative determination in block 350, then it may be determined in block 360 that a print media jam has occurred. Suitable actions may then be taken, such as issuing an alarm signal, stopping the advance of the print medium, or the like.

In case of a positive determination in block 350, indicating that the trailing edge of the print medium has reached the hole 20 and therefore the rise in pressure at the hole does not indicate a malfunctioning, the method may return to block 300.

In implementations of methods as illustrated by FIG. 8 the hole 20 may be placed at or after a print zone of the printing apparatus, in a direction of print media advance. The predetermined time period or predetermined print media advance length used in block 350 may be the time that the trailing edge of the print medium takes to reach the position of the hole 20 on the platen, and may therefore depend on the length of the sheet being printed, as well as on the speed of advance, the desired level of security, etc.

In some implementations of a method as disclosed herein, the method may comprise using the same print media detecting system, such as disclosed with reference to FIGS. 1 to 4, for detecting a potential print media jam at the print zone, for example as disclosed in FIG. 7, and for detecting a potential print media jam downstream of the print zone, as disclosed in FIG. 8.

Although a number of particular implementations and examples have been disclosed herein, further variants and modifications of the disclosed devices and methods are possible. For example, not all the features disclosed herein are included in all the implementations, and implementations comprising other combinations of the features described are also possible.

The invention claimed is:

1. A method for detecting the presence of print media on a platen of a printing apparatus and on which print media may advance, the method comprising:

measuring the air pressure in a position associated with a hole in the platen of the printing apparatus, the hole being in fluid communication with a vacuum source and being open towards a print media advance surface of the platen determining that print media is present if the measured air pressure is below a predetermined threshold; and upon detecting the presence of print media at the hole, continuing measuring the air pressure at the hole, and determining that a print media jam has occurred if, within a predetermined time period or a predetermined print media advance length after a triggering event, the measured pressure rises above a predetermined threshold.

2. The method of claim 1, further comprising:

providing the hole in a portion of the platen that is recessed with respect to the print media advance surface; and providing a vacuum chamber under the platen in correspondence with the recessed portion, whereby the hole is in fluid communication with the vacuum source through the vacuum chamber.

3. The method of claim 2, further comprising:

providing a vacuum opening in the recessed portion of the platen, open towards the print media advance surface of the platen and open towards the vacuum chamber, such as to provide fluid communication between the hole and the vacuum chamber through the recessed portion of the platen; and connecting a conduit between the hole and a pressure sensor for measuring the air pressure in a position associated with the hole.

4. The method of claim 1, further comprising:

connecting a conduit with a tee branch between the hole and the vacuum source, and connecting the tee branch to a pressure sensor for measuring the air pressure in a position associated with the hole.

5. The method of claim 1, further comprising:

arranging the hole after a print zone of the printing apparatus, in a direction of print media advance.

6. The method of claim 1, wherein the triggering event is the detection of the print media at a predetermined position after the hole in the direction of print media advance.

7. A printing apparatus comprising:

a platen on which print media may advance on a print media advance surface of the platen, the platen having a recessed portion with respect to the print media advance surface;

a vacuum source;

a pressure sensor;

a hole within the print media advance surface of the platen that is open towards a print media advance surface of the platen and is in fluid communication with the vacuum source and with the pressure sensor;

a vacuum chamber between the platen and the vacuum source, in correspondence with the recessed portion and in fluid communication with the hole;

a vacuum opening in the recessed portion of the platen, open towards the print media advance surface and open towards the vacuum chamber;

a conduit connected between the hole and the pressure sensor; and a control unit for detecting the presence of print media at the hole if the pressure sensor measures an air pressure below a predetermined threshold.

8. The printing apparatus of claim 7, wherein the control unit is for determining a print media jam situation if, after a triggering event, the presence of print media is not detected at the hole within a predetermined time period or a predetermined print media advance length.

9. The printing apparatus of claim 7, wherein the platen comprises:

a print zone, wherein the hole in the platen is after the print zone in a direction of print media advance.

10. A printing apparatus comprising:

a platen on which print media may advance on a print media advance surface of the platen, the platen having a recessed portion with respect to the print media advance surface;

a vacuum source;

a pressure sensor;

a hole within the print media advance surface of the platen that is open towards a print media advance surface of the platen and is in fluid communication with the vacuum source and with the pressure sensor; and a control unit for detecting the presence of print media at the hole if the pressure sensor measures an air pressure below a predetermined threshold, and for, responsive to detecting the presence of print media at the hole, determining that a print media jam has occurred if, within a predetermined time period or a predetermined print media advance length after a triggering event, if as the pressure sensor measures the air pressure, the measured air pressure rises above a predetermined threshold.

11. The printing apparatus of claim 10, wherein the platen comprises a portion that is recessed with respect to the print media advance surface and the hole is in the recessed portion, and wherein the apparatus further comprises a vacuum chamber between the platen and the vacuum source, in correspondence with the recessed portion and in fluid communication with the hole.

12. The printing apparatus of claim 11, wherein the platen comprises a vacuum opening in the recessed portion, open towards the print media advance surface of the platen and open towards the vacuum chamber, and wherein the apparatus further comprises a conduit connected between the hole and the pressure sensor.

13. The printing apparatus of claim 10, further comprising:

a conduit for fluid communication of the hole with the vacuum source, wherein the conduit comprises a tee branch connected to the pressure sensor.

14. The printing apparatus of claim 10, wherein the platen comprises:

a print zone, wherein the hole in the platen is after the print zone in a direction of print media advance.

* * * * *